US007047895B2

(12) United States Patent
Block et al.

(10) Patent No.: US 7,047,895 B2
(45) Date of Patent: May 23, 2006

(54) CORNER TURNING ASSIST DEVICE FOR A SEWING MACHINE

(75) Inventors: Paul Block, Nesconset, NY (US); Michael Lydick, Medford, NY (US); Lewis Doom, Stonybrook, NY (US)

(73) Assignee: Galkin Automated Products Inc., West Babylon, NY (US)

( * ) Notice: Subject to any disclaimer, the term of this patent is extended or adjusted under 35 U.S.C. 154(b) by 0 days.

(21) Appl. No.: 10/953,394

(22) Filed: Sep. 29, 2004

(65) Prior Publication Data

US 2006/0070562 A1 Apr. 6, 2006

(51) Int. Cl.
*D05B 19/00* (2006.01)

(52) U.S. Cl. ..... 112/470.03

(58) Field of Classification Search ..... 112/470.03, 112/470.01, 470.07, 475.03, 475.04, 2.1, 112/308, 309, 470.05, 470.18
See application file for complete search history.

(56) References Cited

U.S. PATENT DOCUMENTS

| | | | | |
|---|---|---|---|---|
| 5,396,854 | A * | 3/1995 | Noqueras | 112/470.18 |
| 5,520,129 | A | 5/1996 | Porter et al. | |
| 5,529,004 | A * | 6/1996 | Porter et al. | 112/470.03 |
| 5,908,004 | A | 6/1999 | Porter et al. | |
| 6,000,352 | A | 12/1999 | Porter et al. | |
| 6,082,277 | A * | 7/2000 | Block et al. | 112/2.1 |

* cited by examiner

*Primary Examiner*—John J. Calvert
*Assistant Examiner*—Brian Kauffman
(74) *Attorney, Agent, or Firm*—Keusey, Tutunjian & Bitetto, P.C.

(57) ABSTRACT

A corner turning assist device for a sewing machine includes at least one sensor and at least one rotating mechanism engaging the workpiece from the underside of the same. The at least one sensor(s) provides signaling to a motor and the at least one rotating mechanism to indicate when the workpiece has reached a point for pivoting.

8 Claims, 11 Drawing Sheets

CORNER TURNING ASSIST DEVICE FOR A SEWING MACHINE

BACKGROUND OF THE INVENTION

Field of the Invention

The present invention generally relates to sewing machines and, more particularly, to a corner turning assist device for a sewing machine.

BACKGROUND OF THE INVENTION

In forming corner stitches for, e.g., a mattress, the raw edges of a rectangular piece of quilted fabric are closed with an "overlock" sewing stitch, while applying a piece of "flange" material to the outer perimeter as the machine sews. The sewing machine has a small oscillating trim edge knife that sits just outside the needle sewing line, cutting a smooth edge for the stitch to lay over. When the operator reaches the corners of the rectangle, they actually turn a radius corner, trimming away the square corner as they sew. This radius ideally, matches the radius of downstream components, namely, the radius of the corner springs and the radius of the accompanying boarder wire, used in the final assembly of the mattress. Inconsistencies in the radius formed by the sewing machine operator (e.g., a 3.25 inch or 3.5 inch radius with a 3 inch ideal specification) cause production problems downstream that require an increase in the skill levels of other operators who need to assemble the final pieces of the mattress and correctly match up the corners and align the final pieces.

Other conventional approaches to obtaining consistent corner radiuses have employed automated sewing workstations that mechanically manipulate the sewing material throughout the entire sewing cycle, using combinations of conveyor feeds and corner turning devices, to form the side and corner stitches. The corner forming devices of these sewing workstations are based on an indexing driven circular plate. This plate drops down on the material, at a consistent location relative to the square edge corner (located by various edge sensors) and wrenches the material an angular increment, in time with the needles of the sewing machine. That is, when the needles come out of the sewing material after forming a stitch, the indexing driven circular plate turns "x" degrees, turning the material "x" degrees, as well as trimming away "x" degrees of the square corner). When the sewing material has completely formed a corner (as determined by an array of edge sensors), the indexing driven circular plate retracts, and a conveyor drive of the sewing workstation assumes control of the material, sewing down another long side of the material.

Disadvantageously, the aforementioned sewing workstations are problematic in that the associated mechanisms are inherently complicated and expensive. By the nature of the forces involved, these mechanisms are disproportionately large, fueling a spiral cycle of larger motors, larger motor mounting brackets, larger turning arms, and so forth. The end result is a big sewing workstation, which still requires a human being to feed it with material, and get it started. Further, such a sewing workstation is considerably more expensive than its manual counterpart, and requires a highly trained and adept engineer to be on staff to troubleshoot problems when they occur.

Accordingly, it would be desirable and highly advantageous to have a corner turning assist device for a sewing machine that overcomes the above described problems of the prior art.

SUMMARY OF THE INVENTION

The problems stated above, as well as other related problems of the prior art, are solved by the present invention, a corner turning assist device for a sewing machine.

According to an aspect of the invention, the corner turning assist device for a sewing machine includes a corner turning assist mechanism disposed under the sewing material, and at least one sensor for indicating a position of the sewing material in the sewing machine and activating the corner turning assist mechanism when the sewing material reaches a predetermined point for a corner sewing operation.

According to another aspect of the invention the corner turning assist mechanism is a corner pivot plate for descending on a pre-specified pivot point location and forcing the sewing material to move radially when sewing down a straight side.

According to yet another aspect the invention, the corner turning assist device includes at least one gripping device positioned below the sewing material and adapted to operate in response to the at least one sensor.

A description will now be given of some of the many advantages of the present invention over the prior art. The corner turning assist device of the present invention is substantially less expensive and simpler to trouble shoot and maintain that prior art solutions. Also, despite a company's best efforts to automate a sewing operation, a certain element of human tailoring is involved that makes a product's quality exceed that of a completely automated machine. The technology has not yet been introduced that can replicate the dexterity and reaction time of the human hand, even those hands of the lower skilled operators. By enhancing the operation with a work aid, the operator remains (as they remain even in the existing automated systems) an integral part of the operation. However, the skill level required to perform a perfect corner stitch is reduced tremendously, with an immediate increase in product quality and consistency.

A further advantage the present invention is that it does not require additional floor space, a valuable commodity in the production area. The larger, more complicated prior art systems demand a larger footprint.

Moreover, another advantage of the present invention is flexibility. Motor speeds will be user-defined parameters. Operators who are being trained with the system can start off with Y2 speed parameters (relative to maximum) while top of the line operators can ask for higher values as they master the timing and the rhythm of the system. This give operators and production staff control of the equipment, in place of the fixed control more complicated automated systems have over its operators.

Additionally, the present invention may be incorporated into existing sewing machines as well as new sewing machines.

These and other aspects, features and advantages of the present invention will become apparent from the following detailed description of preferred embodiments, which is to be read in connection with the accompanying drawings.

DETAILED DESCRIPTION OF PREFERRED EMBODIMENTS

The present invention is directed to a corner turning assist device for a sewing machine. Advantageously, the present invention provides a significantly less complex system as compared to the prior art.

Figure 1:
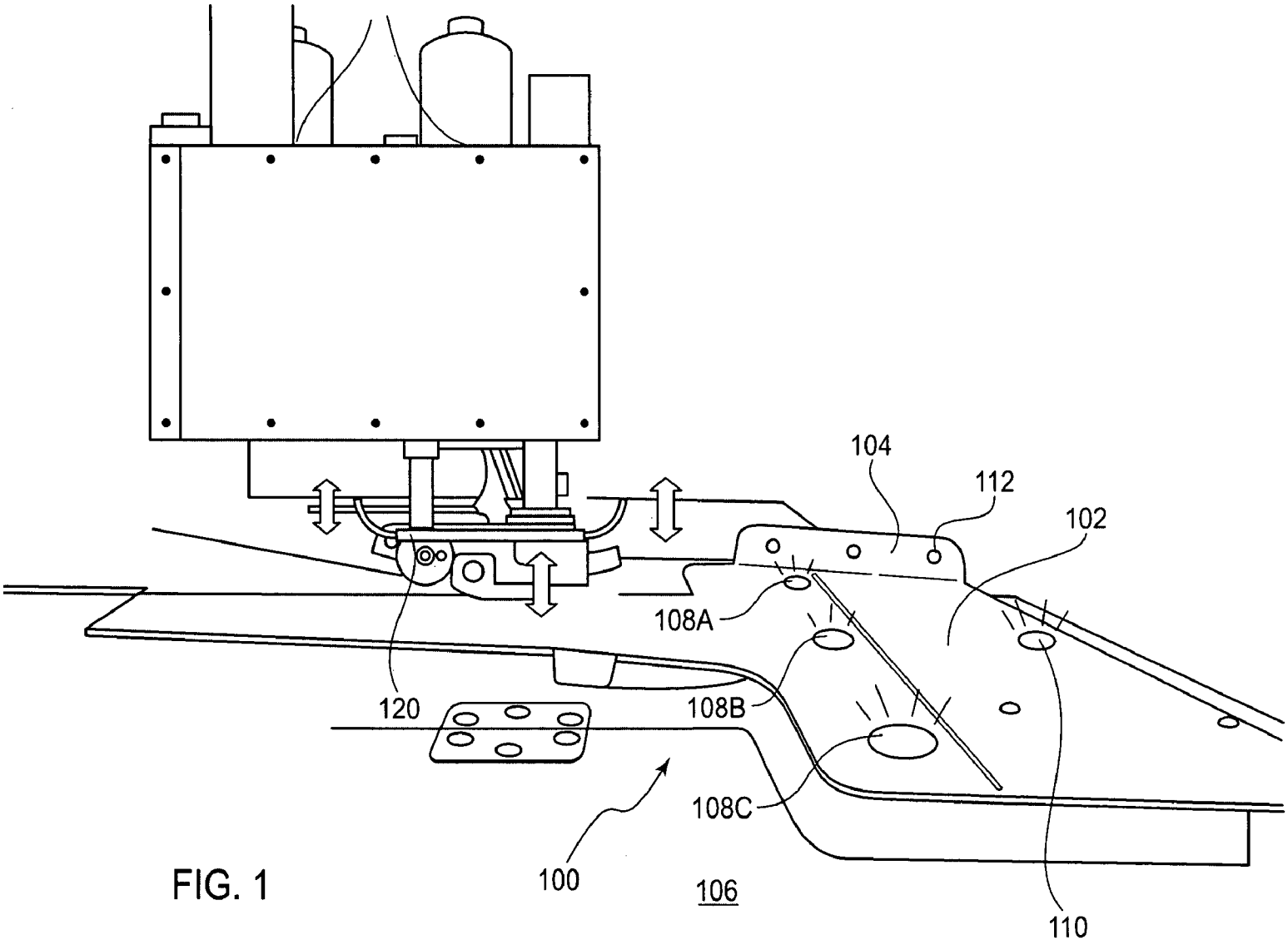
FIG. 1 is a diagram illustrating a corner turning assist device for a sewing machine, according to an illustrative embodiment of the present invention.
Figure 2:
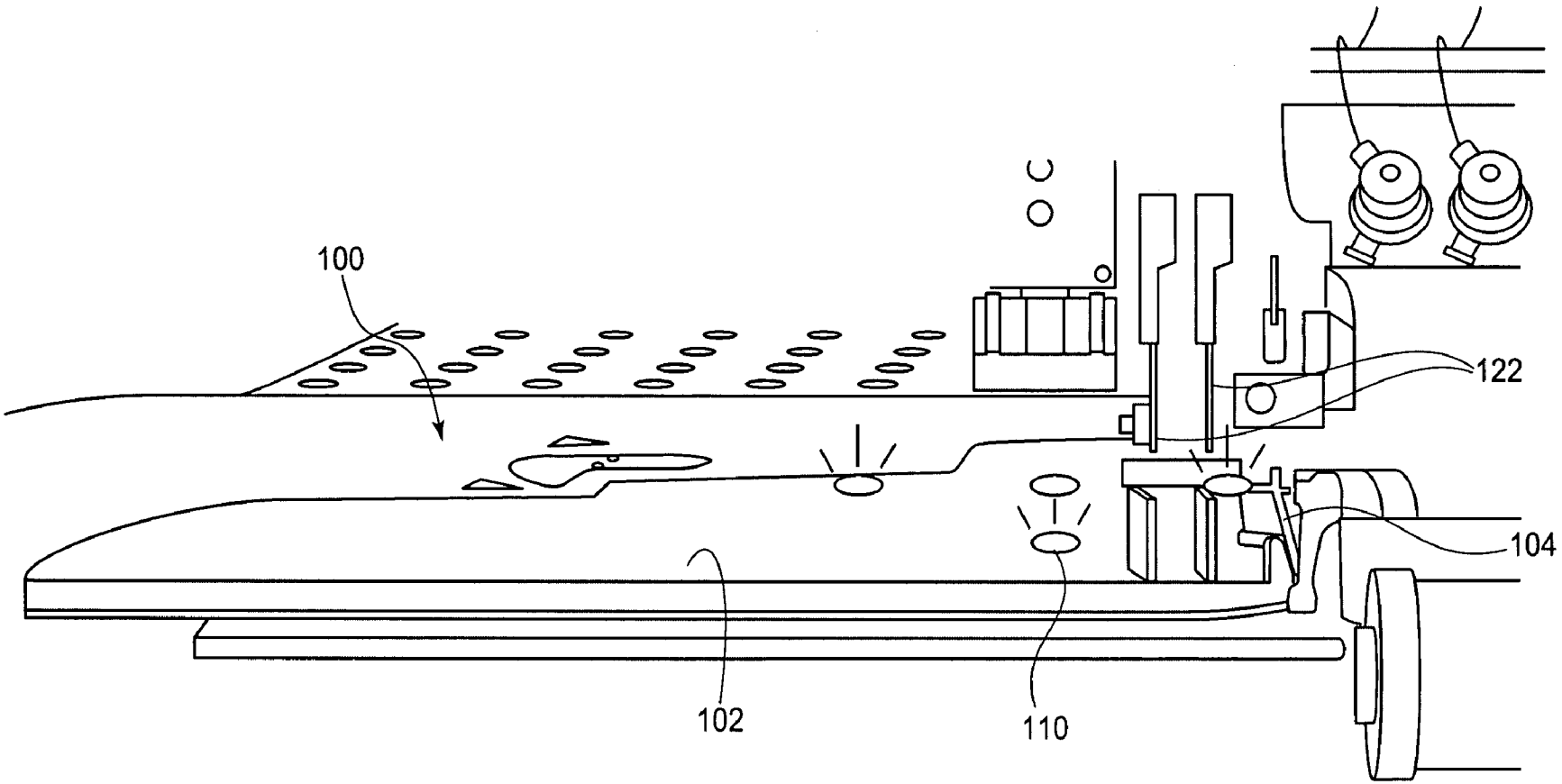
FIG. 2 is front view of the corner turning assist device for a sewing machine according to another embodiment of the invention.
Figure 3:
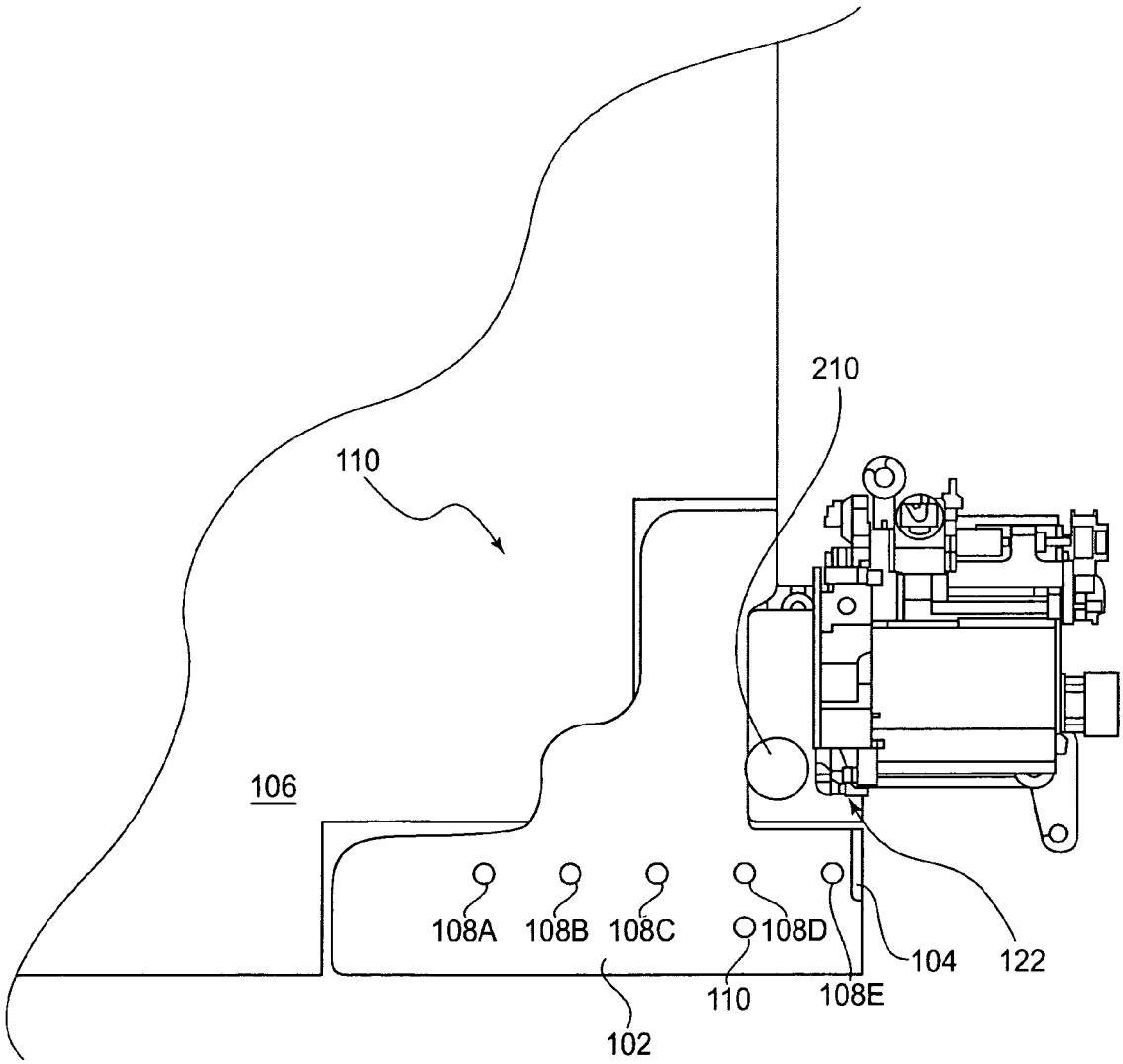
FIG. 3 is a top plan view of the corner turning assist device for a sewing machine according to an embodiment of the invention.

FIGS. 1–3 illustrate a corner turning assist device 100 for a sewing machine, according to an illustrative embodiment of the present invention. The corner turning assist device 100 includes a corner pivot plate 102 situated in a table 106 and having a series of material edge sensors 108, 110 and 112. The corner pivot plate 102 is just a pivot center placed at a specific location, and may take the form of, for example, a lazy-Susan type plate, a conical point, or even a ball. That is, the corner pivot plate may be anything that is capable of being dropped down in a proper pivot point location and assists in the radial movement of the sewing material, as compared to axially (when sewing down a straight side).

This pivot of the material by corner pivot plate 102 will be passive, not driven. Thus, when the operator loads the material under the sewing machine presser foot 120, this pivot (alongside its guard) will also lift. When the presser foot drops to clamp the material, the pivot plate 102 will fall under its own weight, with no actuator pressure, skimming the surface of the material lightly as it passes beneath. In another embodiment of the present invention, there may be some form of rubber flap system that holds the pivot up above the guard skid and allows the pivot to be pushed through under pressure. When the material is sewn up to the corner, the first row of sensors 110 will cause the sewing machine motor to drop down to a lower speed. When the edge of the material reaches the last bank 108*a*–108*e* the sewing machine stops, and the pivot plate 102 drops down through the guard into the loft of the material at the precise locations that will give the customer their specified finished radius. The operator will then manipulate the material with the aid of the pivot, forced to make the corner the exact same way, corner-to-corner, and panel-to-panel. When the edge sensor bank 112 located on the raised edge 104 sees that the material has been turned a full 90 degrees, the pivot plate 102 retracts back up through the guard skid, and allows the operator to sew at normal speed. Once the material has passed sensors 112 on edge plate 104, the motor of the sewing machine can be automatically increased in speed.

Figure 4:
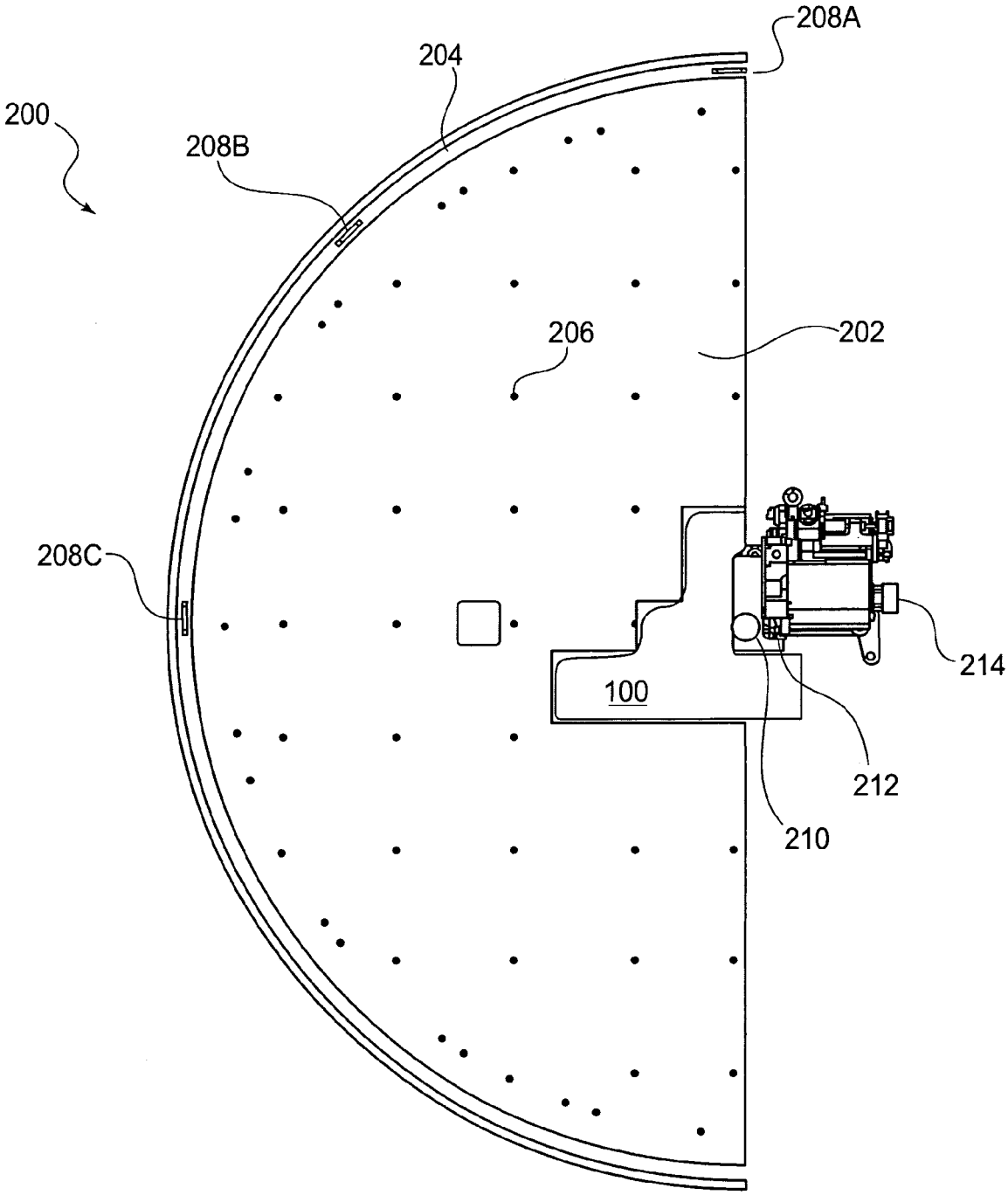
FIG. 4 is a top view of the corner turning assist device for a sewing machine according to another embodiment of the invention.
Figure 5:
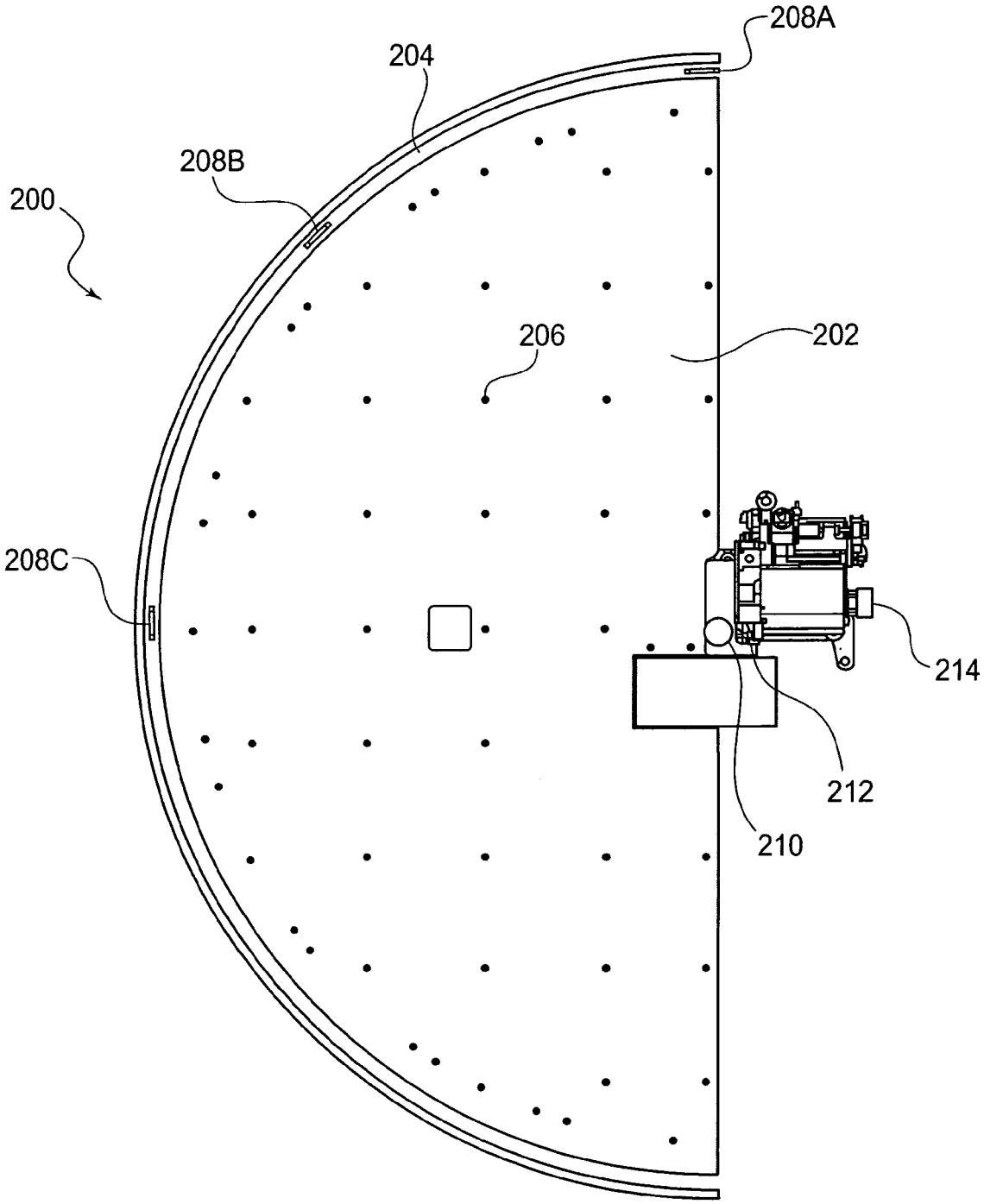
FIG. 5 is a top view of the corner turning assist device for a sewing machine according to yet another embodiment of the invention.

FIGS. 4–7 show the corner turning assist device 200 according to another embodiment of the invention. As shown in FIG. 4, the corner turning assist device of the present invention can include pivot plate 100 and/or the semi-circular table 200. As shown, table 202 includes a circumferentially disposed track 204 that includes grippers 208*a*, 208*b*, 208*c*. During operation, when the fabric reaches a certain point on the table 202, grippers 208 rise from the track 204, grip the fabric from underneath, and rotate 90 degrees in a counter clockwise direction. This rotation is with respect to a pivot point 210 positioned adjacent the sewing needles 212.

Table 202 can also include a plurality of air holes 206 which assist in maintaining the fabric flowing over the table and prevent snagging or interruption of the sewing process.

Figure 6:
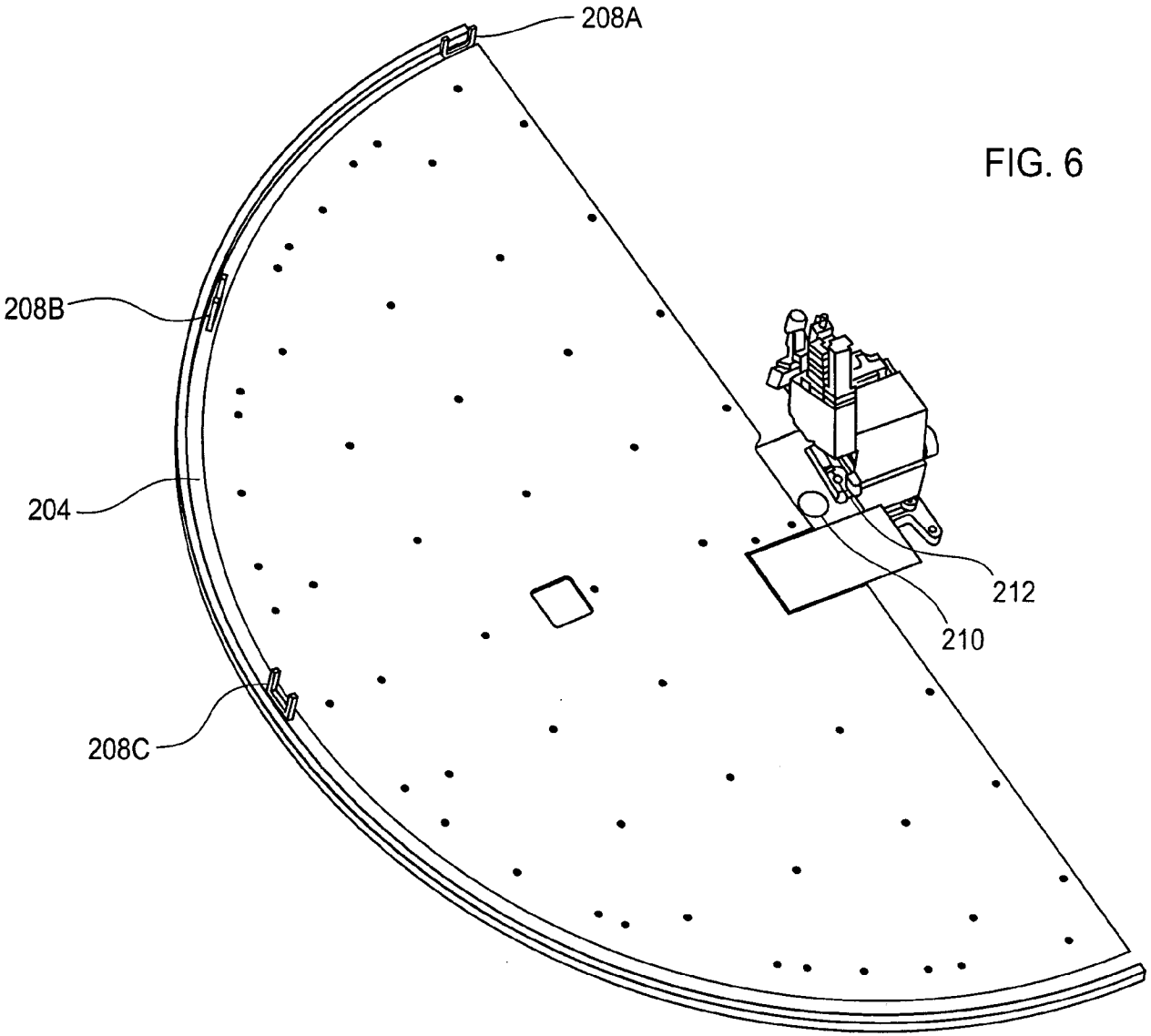
FIG. 6 is a perspective view of the corner turning assist device for a sewing machine according to an embodiment of the invention.
Figure 7:
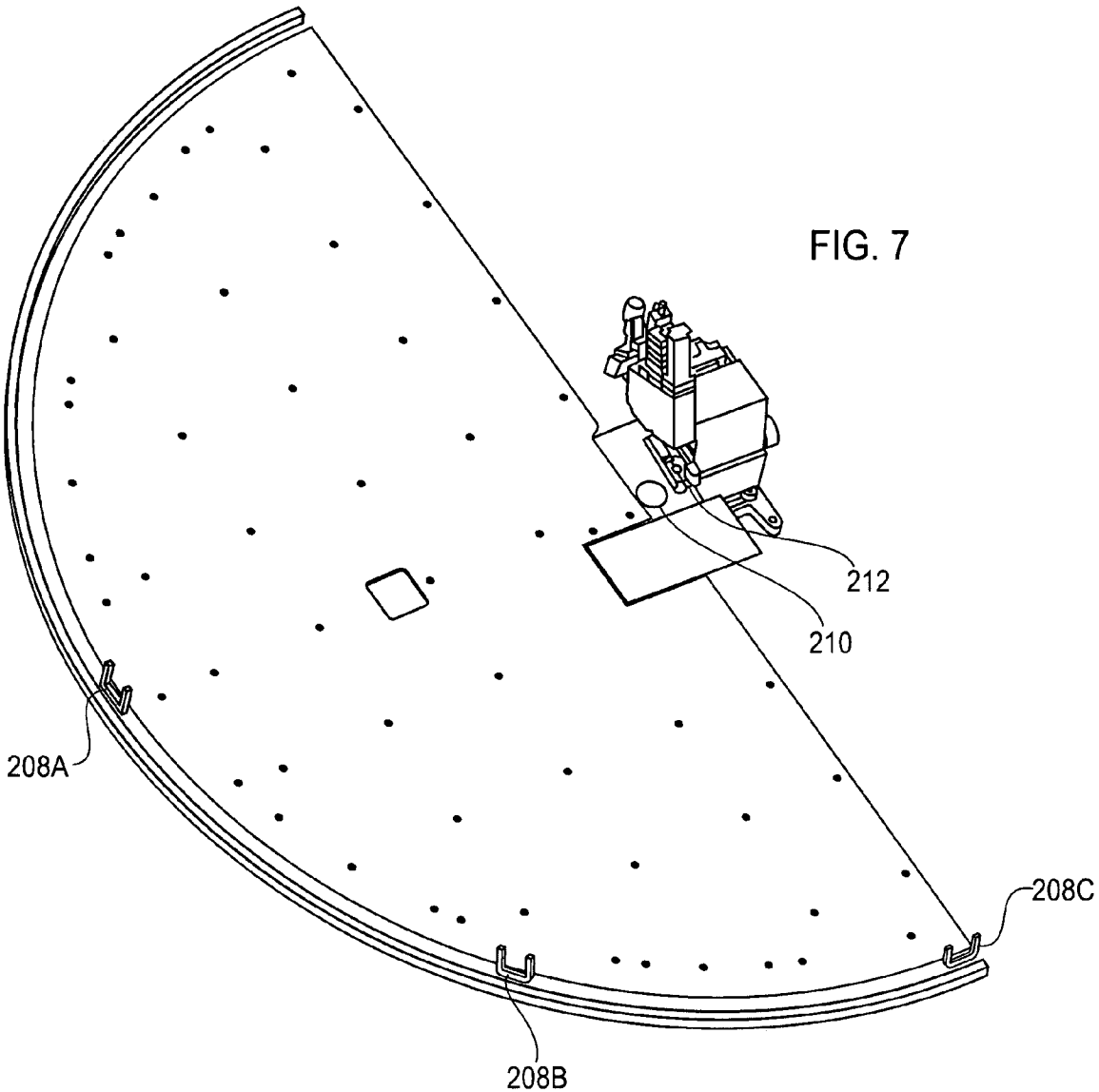
FIG. 7 is a perspective view of the corner turning assist device showing a different operative position according to an embodiment of the invention.
Figure 8B:
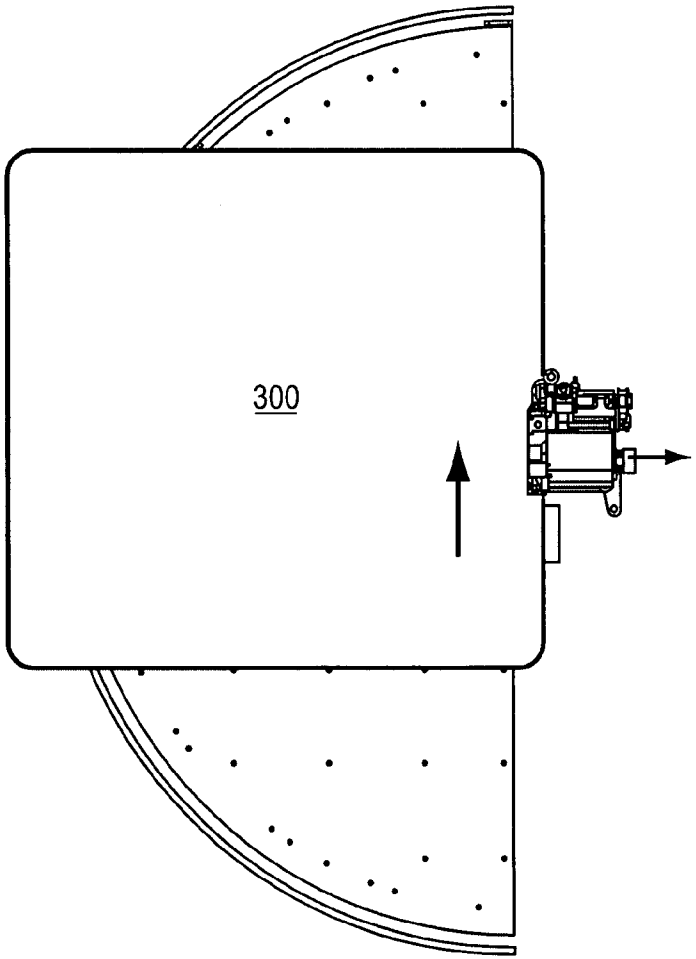
FIGS. 8*a*–8*g* show the manipulation of a workpiece through the corner turning assist device for a sewing machine according to an embodiment of the invention.
Figure 8A:
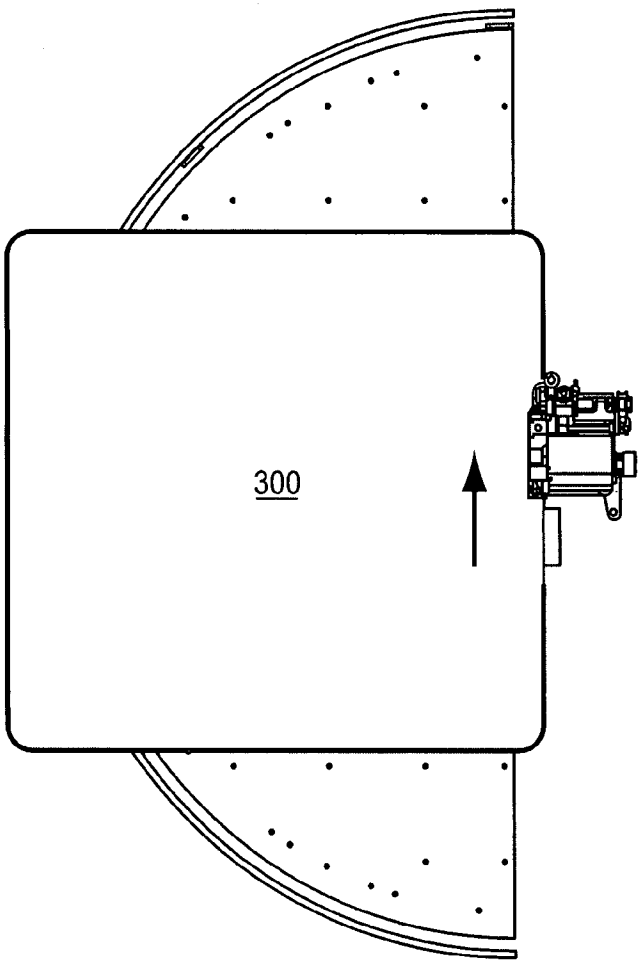
Figure 8D:
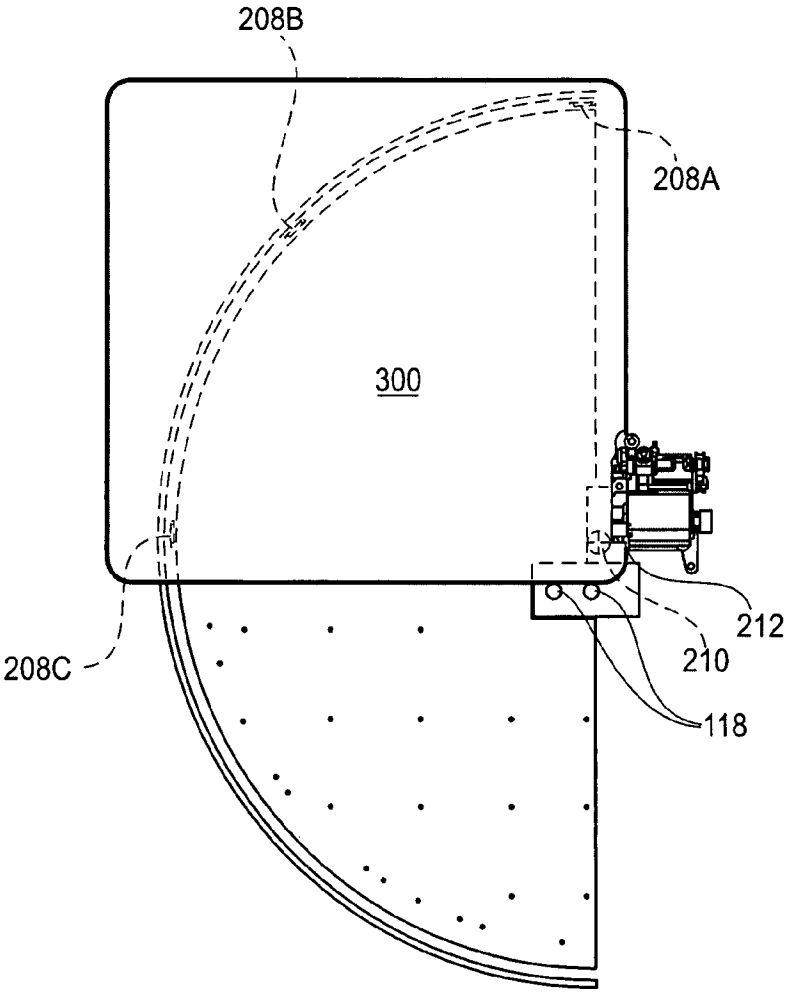
Figure 8C:
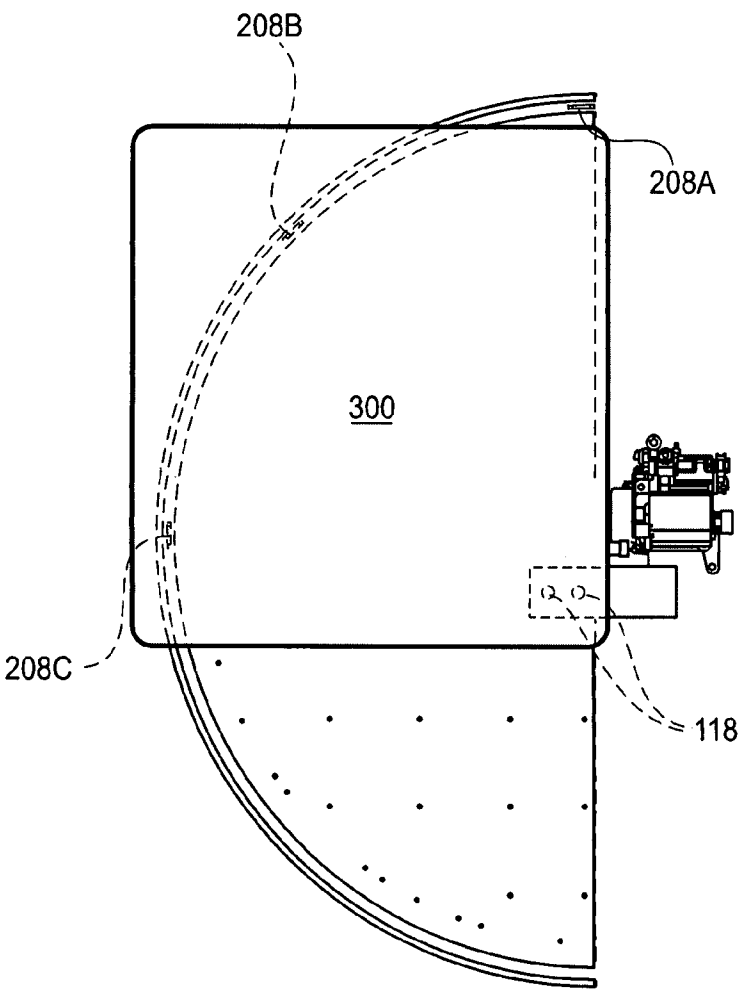
Figure 8F:
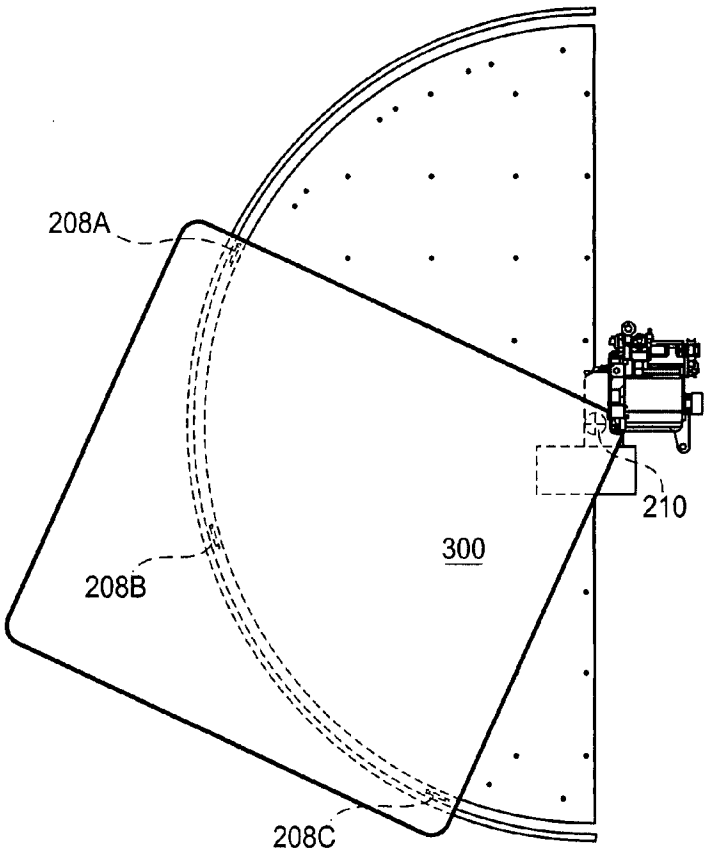
Figure 8E:
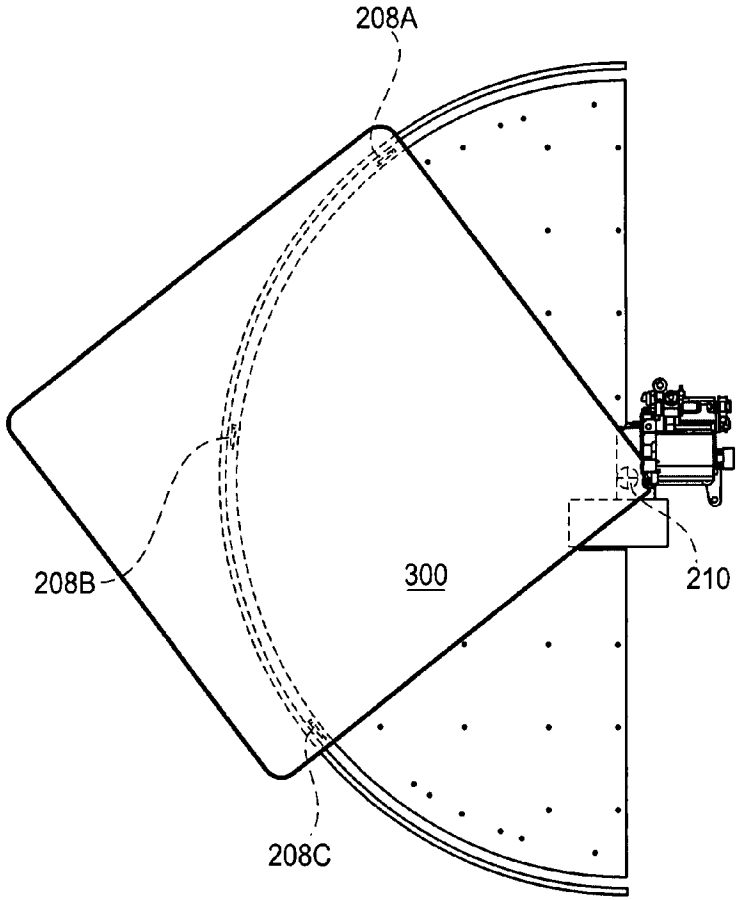
Figure 8G:
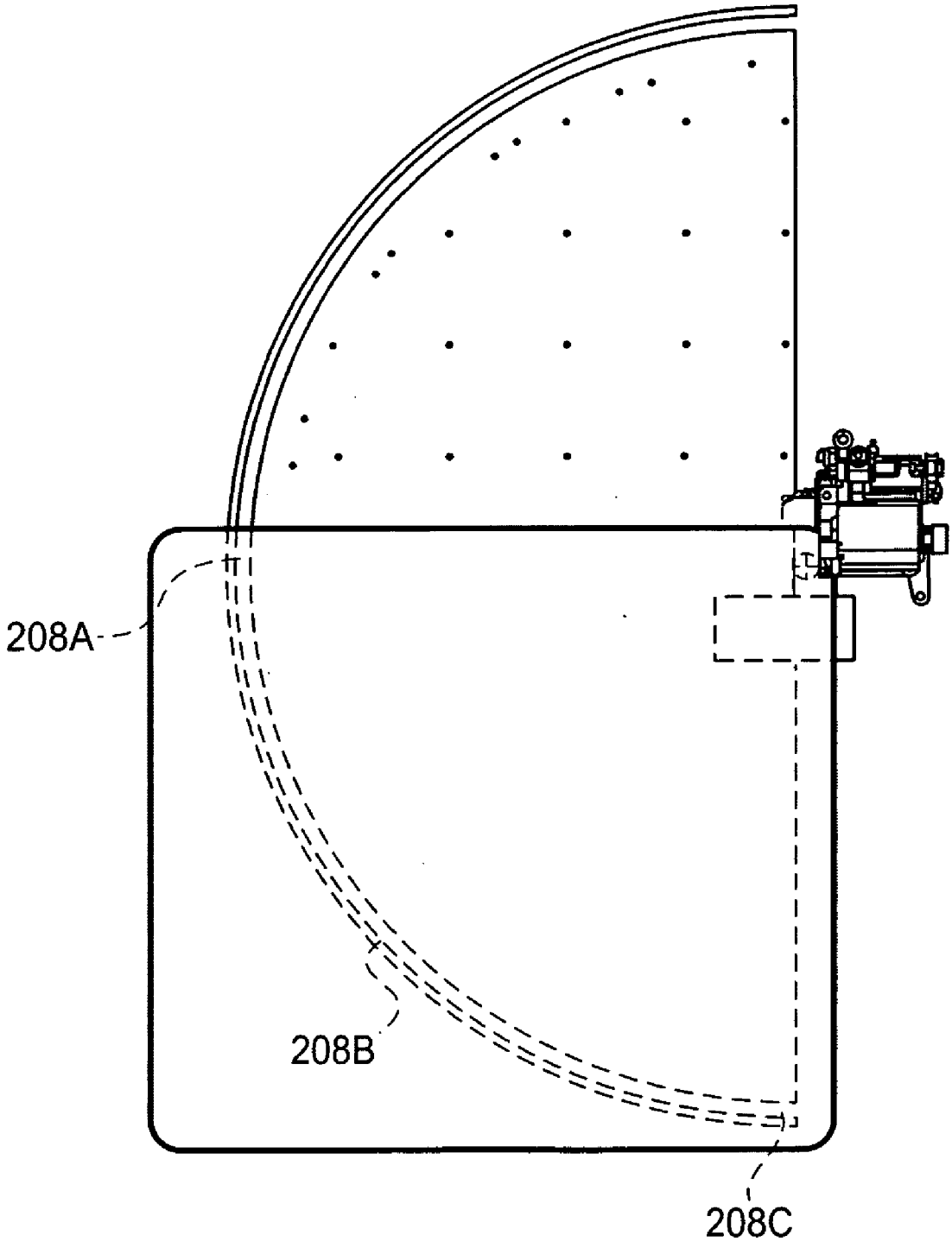

FIG. 6 shows the initial position of grippers 208 at the top or forward end of the table. FIG. 7 shows the final position of the grippers 208 after the 90 degree counter clockwise rotation. Once the rotation of grippers 208 is complete, they are retracted back into track 204 and returned to their initial position.

By way of example, FIGS. 8*a*–8*g* show a workpiece 300 passing through the corner turning assist system of the present invention. As workpiece 300 proceeds along a straight line and reaches a point where a corner is to be made (See FIG. 8*d*), grippers 208*a*, 208*b* and 208*c* rise from the table and grip the underside of the workpiece 300 and begin to rotate the workpiece about pivot point 210 while the sewing action by the needles 212 is continued along the edge.

A plurality of sensors in the table indicated when the edge of workpiece 300 has reached the turning point so as to automatically activate the rotation grippers 208. By way of example, sensors 118 (FIGS. 8*c* and 8*d*) are positioned along the material stopping point for the pivot movement. The sensors can operate to sense when the material has arrived just before the pivot point (e.g., to slow the material down), and to engage a motor stop/brake. There can be one or more sensors that operate in this fashion. Thus, when sensors 118 are active, they will sense the end of the material indicating the time and place for a pivot, in addition to be being in communication with the motor stop/brake (and/or grippers 208) to enable the control of the machine and the workpiece to effect a perfect sewn corner without requiring too much use input.

Once the complete 90 degree counter clockwise rotation is completed above pivot point 210 (FIG. 8*g*), grippers 208*a*, 208*b* and 208*c* are retracted from their engagement with the underside of workpiece 300, and the workpiece sewing continues along the next straight edge of the same. Grippers 208 are returned to their start position and await the next corner turning operation.

The movement of grippers 208 along track 204 is preferably tied to the operation of the motor of the sewing machine, such that a continued approximation of the speed at which the grippers need to move in order to keep up with the motor speed is maintained to provide the smoothest operation and most efficient sewing action for the corner.

In accordance with one embodiment, and encoder feedback method of controlling the motor with respect to the workpiece is implemented. In this method, absolute position rotary encoders are mounted on the motor shaft that drives the gripper chain (not shown), as well as the shaft of the passive pivot axis. The two motions would be synchronized to insure matched rotation.

In accordance with another embodiment, an encoder feedback plus stitching counting method of controlling the motor with respect to the workpiece is implemented. In this mode, one (1) absolute position rotary encoder is mounted on the motor shaft that drives the gripper chain (not shown), and a simpler method of to count each stitch of the sewing head or rotation of the sewing machine shaft is integrated. For example, by determining how many stitches a corner consists of, such information can be used to translate the stitch count into a matching/corresponding rotation. By way of example, if a corner consists of 90 stitches, then the corresponding rotation would be 5 stitches=5 degrees (i.e., 1 stitch for each degree up to the full turn 90 degrees).

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A corner turning assist device for a sewing machine, the sewing machine having a motor for driving at least one needle into sewing material, the corner turning assist device comprising:

a corner turning assist mechanism disposed under the sewing material; and at least one sensor for indicating a position of the sewing material in the sewing machine and activating said corner turning assist mechanism when the sewing material reaches a predetermined point for a corner sewing operation, said corner turning assist mechanism having at least one gripping device positioned below the sewing material and adapted to operate in response to said at least one sensor.

2. The corner turning assist device according to claim 1, wherein said at least one sensor further comprises a plurality of sensors, said plurality of sensors causing the corner turning assist mechanism to be activated and deactivated in response to a position of the sewing material.

3. The corner turning assist device according to claim 1, wherein said corner turning assist mechanism comprises a corner pivot plate for descending on a pre-specified pivot point location and forcing the sewing material to move radially when sewing down a straight side.

4. The corner turning assist device of claim 3, wherein said corner pivot plate is one of a lazy-Susan type plate, a conical point, or a ball.

5. The corner turning assist device of claim 3, wherein said corner pivot plate is passive.

6. The corner turning assist device of claim 1, wherein the pre-determined amount is approximately ninety degrees.

7. The corner turning assist device of claim 2, wherein said plurality of edge sensor banks further is for causing the motor to drop to a lower speed than a current speed when the sewing material is sewn up to the corner, prior to causing the motor to stop and the corner pivot plate to descend on the pre-specified pivot point location.

8. The corner turning assist device according to claim 1, wherein said corner turning assist device comprises a plurality of gripping devices arranged in a semi-circular track positioned under the sewing material, said plurality of gripping devices adapted to move no more than ninety degrees within said track and with respect to an original starting position.

* * * * *